United States Patent [19]

Husslein et al.

[11] Patent Number: 4,882,462

[45] Date of Patent: Nov. 21, 1989

[54] CONTROL APPARATUS FOR HEATING, DEFROSTING AND/OR COOKING FOODS WITH MICROWAVE ENERGY

[75] Inventors: Julius Husslein, Vachendorf; Helmut Hess; Wolfgang Beifuss, both of Traunreut, both of Fed. Rep. of Germany

[73] Assignee: Bosch-Siemens Hausgeräte GmbH, Munich, Fed. Rep. of Germany

[21] Appl. No.: 288,696

[22] Filed: Dec. 22, 1988

[30] Foreign Application Priority Data

Dec. 23, 1987 [DE] Fed. Rep. of Germany ..... 3743921

[51] Int. Cl.[4] ..... H05B 6/68

[52] U.S. Cl. ..... 219/10.55 B; 219/10.55 E; 219/10.55 F; 99/325

[58] Field of Search ..... 219/10.55 B, 10.55 R, 219/10.55 E, 10.55 M, 10.55 F, 10.55 A; 99/325, 327, 451, DIG. 14

[56] References Cited

U.S. PATENT DOCUMENTS

| | | | |
|---|---|---|---|
| 4,210,795 | 7/1980 | Lentz | 219/10.55 B |
| 4,341,937 | 7/1982 | Staats | 219/10.55 M |
| 4,453,066 | 6/1984 | Mori | 219/10.55 M |
| 4,520,251 | 5/1985 | Yokozeki | 219/10.55 M |
| 4,525,615 | 6/1985 | Wyland | 219/10.55 M |
| 4,553,011 | 11/1985 | Nakata et al. | 219/10.55 B |

*Primary Examiner*—Philip H. Leung

*Attorney, Agent, or Firm*—Herbert L. Lerner; Laurence A. Greenberg

[57] ABSTRACT

A control apparatus for heating, defrosting and/or cooking foods to be heat-treated by exposure to microwave energy at a given location inside a closed cooking chamber includes a microwave generator beaming microwave energy into the cooking chamber, and a sensor detecting the state of the food and controlling the energy beamed into the cooking chamber. The sensor is disposed in the cooking chamber filled with microwave energy between the microwave generator and the given location for food exposed to microwave energy, for detecting a value for microwave energy potential and controlling the output of the microwave generator.

6 Claims, 1 Drawing Sheet

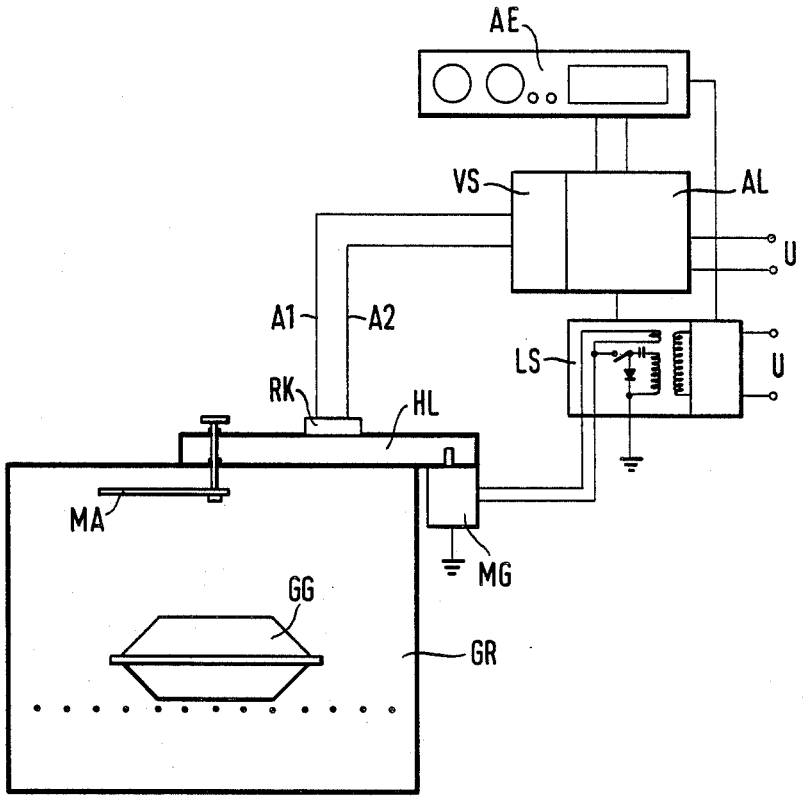
AE
VS
AL
U
A1
A2
LS
U
RK
HL
MA
MG
GG
GR

CONTROL APPARATUS FOR HEATING, DEFROSTING AND/OR COOKING FOODS WITH MICROWAVE ENERGY

The invention relates to a control apparatus for heating, defrosting and/or cooking foods to be heat-treated by exposure to microwave energy inside a closed cooking chamber, in particular in household ovens.

Microwave ovens or microwave ranges with or without additional thermal heat sources, in which microwave energy is fed into a microwave-proof cooking chamber through a waveguide by means of a microwave generator, i.e. a magnetron, are used in households. A permissible microwave frequency of 2.45 GHz is used for this purpose. The microwave energy is usually supplied at 600 to 700 Watts. The microwaves supplied to the cooking chamber penetrate more or less deeply and intensely into the food, depending on the type and consistency of the food, and the microwave energy is converted in the food into heat energy and is used for performing cooking operations or for defrosting food. In known ovens it is possible to set variable output ranges up to a maximum output, depending on the desired treatment and the type of food. Several possibilities are available for this purpose. It is possible, for example, to vary the microwave output by the addition or subtraction of capacitors in the magnetron circuit. A further, widely used method for reducing the maximum output is achieved by a clocked generation of the maximum output, i.e. by interrupting the microwave radiation at relatively short intervals for set periods of time. Selection of the appropriate microwave output for the respective cooking process in the conventional household devices is exclusively up to the operator. Thus, the operator has to use great care in order to avoid inappropriate, inefficient or in particular dangerous settings of the microwave energy. It is also possible to provide fixed programs or individually adjustable programs, similar to roasting processes with a purely thermal treatment of the food, in order to control variable microwave treatments of the food successively in phases. The problem with these methods is that because of the composition of the individual foods, the actual cooking phases differ to a lesser or greater degree from the set values. Particularly large deviations of the required treatment time occur in connection with defrosting processes.

In order to overcome these problems it is known to provide sensors for the determination of the actual condition of the food, which are in the form of a so-called spit and which detect the respective temperature of the food. The sensors may also be in the form of air sensors or humidity sensors which detect the state of the exhaust air present in or being drawn out of the cooking chamber, in order to attempt to indirectly determine the actual state of the food. Both methods have their problems and for these reasons have been practically unable to succeed to everyone's satisfaction.

It is accordingly an object of the invention to provide a control apparatus for heating, defrosting and/or cooking foods with microwave energy, which overcomes the hereinafore-mentioned disadvantages of the heretofore-known devices of this general type and with which it is possible to determine the respective state of the foods in an advantageous manner without intrusion into the food, but still at a close distance, during the course of the treatment of the foods with microwave energy.

With the foregoing and other objects in view there is provided, in accordance with the invention, a control apparatus for heating, defrosting and/or cooking foods to be heat-treated by exposure to microwave energy at a given location inside a closed cooking chamber, especially in a household oven, comprising a microwave generator beaming microwave energy into the cooking chamber, and a sensor detecting the state of the food and controlling the energy beamed into the cooking chamber, the sensor being disposed in the cooking chamber filled with microwave energy between the microwave generator and the given location for food exposed to microwave energy, for detecting a value for microwave energy potential and controlling the output of the microwave generator.

This control apparatus according to the invention makes use of the realization that heat-treatment of food changes the food's ability to absorb microwaves. These changes are particularly apparent when the food changes from the frozen to the thawed state. These changes in the food are detected with the aid of the control apparatus of the invention since a sensor is disposed in the chamber between the microwave generator and the food to be treated with microwaves, which detects the microwave potential present at a given time. The microwave energy potential in this chamber depends on one hand on the microwave energy beamed into this chamber by the microwave generator, and on the other hand on the microwave energy which is absorbed by the food. Thus it is possible to evaluate either the relation ship between the microwave energy supplied and absorbed as an absolute value of microwave energy potential of the chamber, or its changes over time.

The control apparatus according to the invention is preferably used in ovens in which the food is heat-treated by means of microwave application. In principle the features of the invention are also suitable for a purely thermal treatment of the food to be heat-treated. In the latter case, however, microwaves must be supplied to the cooking chamber in order to take measurements. However, the microwave supply may be very small, i.e. of weak intensity and in the form of pulses.

In accordance with another feature of the invention, there is provided an output control device or process flow control device connected to the microwave generator, and a logic control circuit connected between the sensor and the output control device for controlling the output control device and the microwave generator in dependence on the state of the treatment of the food detected by the sensor.

In accordance with a further feature of the invention, the logic control circuit triggers a reduction of microwave energy for a defrost mode when a defrost temperature range is detected by measurement of the field intensity change in the cooking chamber based on a change in microwave absorption capability of food with a thawed surface.

In accordance with an added feature of the invention, the logic control circuit reduces the microwave energy during the defrost mode for a limited period of time and subsequently switches it on again for a period of time determined by detection means of the sensor in the course of a representative change in the field intensity of the microwave energy detected by the sensor during thawing of the surface of the food.

With the aid of this feature, a thawing of food is attained which is as rapid as possible without there being the danger of the surface of the food already beginning to be cooked. As long as the surface area of the food is still frozen, it is possible to supply a relatively large amount of microwave energy or other energy for thawing of the food. If, however, the surface of the food is already thawed, the energy for thawing is reduced to such a degree that a heat balance is achieved between the thawed outer area of the food and the still frozen core of the food. The defrosting process thus can be balanced and optimized in regard to length.

In accordance with an additional feature of the invention, the logic control circuit contains representative values of the field intensity in the cooking chamber in relation to the microwave energy supplied, the logic control circuit compares the representative values with respective actual microwave field intensities detected by the sensor, and the logic control circuit controls the supply of microwave energy by the microwave generator in dependence on the result of the comparison.

In accordance with yet another feature of the invention, the values for initial and/or final conditions determined by the food to be treated are supplied to the logic control circuit.

In accordance with yet a further feature of the invention, there is provided a comparison or evaluation circuit connected downstream of the sensor for detecting microwave potential in the cooking chamber, the comparison circuit containing representative values for an idle mode in the cooking chamber and the comparison circuit shutting off operation of the microwave generator and the generation of microwaves when a corresponding microwave energy potential is detected by the sensor.

In accordance with yet an added feature of the invention, the comparison circuit includes a time function element controlling the shut-off of the microwave generator with a time delay upon receipt of a value preset for the idle mode.

If the supply of microwave energy to the cooking chamber is mistakenly turned on by an operator, although there is no food in the cooking chamber, the use of these switching elements shuts off the supply of microwaves in sufficient time to prevent danger. However, sufficient microwave energy is supplied by the use of the time function element so that very small amounts of food can be sufficiently heat-treated.

In this connection it is also possible to perform two measuring value determinations within short periods of time and to make the shut-off of the microwave supply dependent on the fact that during both measurements, values for the "idle" mode were detected.

Therefore, in accordance with yet an additional feature of the invention, the comparison circuit includes a time function element influencing the comparison circuit to perform a further measurement value detection within a preset period of time, once the sensor has detected a value for the idle mode and to shut off control for the microwave generator, based on the further measurement value detection, if the result is the same.

In accordance with again another feature of the invention, besides receiving the value detected by the sensor in the cooking chamber, the comparison circuit also receives values for the output supplied to the cooking chamber and shuts off the control for the microwave generator, depending on pre-set output values supplying the cooking chamber and on a value detected by the sensor for the idle mode.

In accordance with still another feature of the invention, the comparison circuit only shuts of the microwave generator at maximum microwave output and/or at a given additional high thermal heat output supply.

Therefore, the device only shuts off a relatively high output of microwave energy which might lead to dangerous situations, either by itself or in combination with additional thermal heat output, while minor microwave emissions are not shut off. Due to the microwave losses in the waveguide and cooking chamber elements, it might be a problem to satisfactorily recognize food with a low mass within the cooking chamber by means of microwave technology. Such amounts of food can be treated with low, but sufficient amounts of microwave energy without the danger of automatic shut-off.

In accordance with still a further feature of the invention, the microwave generator only has an output required for the detection of measurement values and an optimum frequency required for the detection of measurement values, and the sensor disposed in the cooking chamber is attuned to the microwave generator, for detecting operational conditions dependent on type, mass and state of the food to be heat-treated within the cooking chamber filled with microwaves.

In accordance with still an added feature of the invention, the sensor is in the form of an inductive or capacitative probe.

In accordance with a concomitant feature of the invention, the sensor is in the form of a directional coupler disposed in the vicinity of a wave guide disposed between the microwave generator and the given location for food.

In this area the microwave sensor is normally not exposed to any appreciable exhaust and therefore does not become dirty. It is possible, particularly in this area, to detect the microwave field conditions with relative precision.

Other features which are considered as characteristic for the invention are set forth in the appended claims.

Although the invention is illustrated and described herein as embodied in a control apparatus for heating, defrosting and/or cooking foods with microwave energy, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

The single FIGURE of the drawing is a diagrammatic and schematic circuit diagram of the principal elements of a microwave oven.

Referring now in detail to the single FIGURE of the drawing, it is seen that microwave energy is supplied through a rotating antenna MA to a cooking chamber GR of the microwave oven, into which food GG which is to be heat-treated has been introduced. The rotating antenna MA receives the microwave energy from a waveguide HL which in turn receives the microwave energy from a microwave generator MG, a magnetron. An output control unit LS which is provided for the control of the magnetron, conventionally contains a high-voltage transformer as well as rectifier and condenser units. These units, as well as switching elements required for a safe microwave operation, need not be considered in detail herein.

Through the use of an indicator/operating panel AE, set values regarding the output and length of time that the microwaves are to be beamed into the cooking chamber GR are entered into a logic control circuit AL which converts these input values for the control of the output control unit. The set values can be displayed on the indicator/operating panel AE.

A microwave directional coupler RK is connected to the waveguide HL. A first output line A1 of the microwave directional coupler RK detects measurement values which correspond to the microwave energy moving through the waveguide HL from the microwave generator MG in the direction towards the cooking chamber GR, and a second output line A2 detects measurement values regarding oppositely moving microwave energy. The relationship between these microwave movements and thus the relationship between the measurement values detected by the output lines A1 and A2 of the directional coupler RK, gives a good indication of which respective microwave energy potential is present in the cooking chamber. This is due to the fact that not only is the microwave generator capable of introducing microwave energy into the wave guide HL, but the cooking chamber returns microwave energy to the wave guide HL in accordance with the microwave energy potential prevailing in the cooking chamber, which can be detected at the output line A2 by the microwave directional coupler RK. Since the microwave potential occurring in the cooking chamber when microwaves are beamed in depends on the ability of the food GG present in the cooking chamber GR to absorb microwaves, the food can be measured by means of this chain of relationships. The ability of the food to absorb microwaves and to transform them into heat depends on the type, mass (weight) and state of the food. If, for example, no food is present in the cooking chamber GR, no significant energy is absorbed in the cooking chamber GR and the returning microwave energy detected by the microwave directional coupler RK will increase to a very large degree in relation to the microwave energy supplied. However, during the implementation of cooking processes, the change in the state of the food, e.g. from the frozen to the defrosted state, becomes important for control measurements.

The output lines A1 and A2 of the directional coupler RK are sent to a comparison circuit VS, which performs a comparison between the measured and supplied measured values and as a result sends a criterion to the logic control circuit AL. The output control unit LS of the microwave generator MG is controlled in dependence on this criterion and is readjusted in regard to the energy demand inside the cooking chamber GR and the values supplied. The values for the particular cooking processes can be supplied to the logic control circuit AL through the indicator/operating panel AE or permanently set values can be stored in the logic control circuit AL for performing standard cooking processes. The continuation of the individual process steps can be controlled and modifications of these steps may be made by superimposition of the values detected by the microwave directional coupler RK, which represent the actual cooked state of the food.

In place of the directional coupler RK in the vicinity of the wave guide HL, a corresponding sensor for detecting the microwave potential may be disposed in the cooking chamber itself between a given location for the food GG and the microwave generator MG. However, it must be taken into consideration that different intensities of microwave energy build up in the cooking chamber GR. In the present exemplary embodiment these microwave intensities are additionally spatially changed through the rotating antenna MA for an even heat-treatment of the food. These circumstances must be considered from a circuit point of view, during detection by measurement of the microwave energy potential in the cooking chamber GR as well as by means of a corresponding disposition of the sensor and by evening out the results of measurement over time.

In the illustrated exemplary embodiment, the microwave energy supplied by the microwave generator is used for heat-treatment of the food GG as well as for measuring purposes. This combination is suggested, but by no means is a prerequisite for the detection performed through measurement. On the contrary, it is also possible to supply microwave energy to the cooking chamber for measurement purposes only. This microwave energy may be relatively weak and may be beamed out only in the time slots required for measuring purposes. There is a further possibility of the microwave frequency for measuring purposes varying from the microwave frequency for performing the cooking process. This has advantages for measurement purposes due to the fact that the different wave lengths of the microwaves have different penetration depths into the food. In this connection it is also possible to use solid state microwave energy generators because the required outputs may be relatively small, as already stated.

However, it is also possible to use microwave techniques only for the purpose of measuring the state of the food and to perform the heat-treatment in connection with or exclusively by means of thermal heating elements.

We claim:

1. Microwave heating apparatus for heating foods to be heat-treated by exposure to microwave energy at a given location inside a closed cooking chamber, having a heating, defrosting and/or cooking mode comprising a microwave generator for beaming microwave energy into the cooking chamber, a sensor for detecting the state of the food and controlling the energy beamed into the cooking chamber, said sensor disposed in the cooking chamber between said microwave generator and the given location for food exposed to microwave energy, for detecting a value for microwave energy potential and for controlling the output of the microwave generator, a rotating microwave antenna in the cooking chamber, an output control device connected to said microwave generator for controlling said microwave generator output, and a logic control circuit connected between said sensor and said output control device for controlling said output control device in dependence on the state of the food as detected by said sensor, wherein said logic control circuit operates to reduce the microwave energy during the defrost mode for a limited period of time and subsequently switches it on again for a period of time as determined by said sensor in the course of change in the field intensity of the microwave energy during thawing of the surface of the food.

2. Microwave heating apparatus for heating foods to be heat-treated by exposure to microwave energy at a given location inside a closed cooking chamber, having a heating, defrosting and/or cooking mode, comprising a microwave generator beaming microwave energy into the cooking chamber, a sensor for detecting the state of the food and controlling the energy beamed into the cooking chamber, said sensor disposed in the cooking chamber between said microwave generator and the given location for food exposed to microwave energy, for detecting a value for microwave energy potential and for controlling the output of the microwave generator, a comparison circuit connected downstream of said sensor for measurement of microwave potential values in the cooking chamber, said comparison circuit containing representative microwave potential values for an idle mode in the cooking chamber and wherein said comparison circuit operates to shut off said microwave generator when a microwave energy potential corresponding to said microwave potential values for an idle mode is detected by said sensor.

3. Control apparatus according to claim 2, wherein said comparison circuit includes a time function element controlling the shut-off of said microwave generator with a time delay upon receipt of a value preset for the idle mode.

4. Control apparatus according to claim 2, wherein said comparison circuit includes a time function element influencing said comparison circuit to perform a further measurement value detection within a preset period of time, once said sensor has detected a value for the idle mode and to shut off control for said microwave generator, based on the further measurement value detection, if the result is the same.

5. Control apparatus according to claim wherein besides receiving the value detected by said sensor in the cooking chamber, said comparison circuit also receives values for the output supplied to the cooking chamber and shuts off the control for said microwave generator, depending on pre-set output values supplying the cooking chamber and on a value detected by said sensor for the idle mode.

6. Control apparatus according to claim 5, wherein said comparison circuit only shuts off said microwave generator at maximum microwave output.

* * * * *